US006466196B1

(12) United States Patent
Isogawa et al.

(10) Patent No.: US 6,466,196 B1
(45) Date of Patent: Oct. 15, 2002

(54) METHOD OF DRIVING BACKLIGHT, CIRCUIT FOR DRIVING BACKLIGHT, AND ELECTRONIC APPARATUS

(75) Inventors: Toshiaki Isogawa; Kazuo Hashimoto, both of Kanagawa; Toshitake Terada, Chiba, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/472,294

(22) Filed: Dec. 27, 1999

(30) Foreign Application Priority Data

Dec. 28, 1998 (JP) ..... 10-374570

(51) Int. Cl.[7] ..... G09G 3/36
(52) U.S. Cl. ..... 345/102; 345/691
(58) Field of Search ..... 345/102, 77, 63, 345/75.1, 691; 349/65, 70

(56) References Cited

U.S. PATENT DOCUMENTS 5,184,117 A * 2/1993 Gauthier ..... 345/102
5,844,540 A * 12/1998 Terasaki ..... 345/102
6,087,786 A * 7/2000 Allen et al. ..... 315/246

* cited by examiner

*Primary Examiner*—Bipin Shalwala
*Assistant Examiner*—Ricardo Osorio
(74) *Attorney, Agent, or Firm*—Frommer Lawrence & Haug LLP; William S. Frommer

(57) ABSTRACT

In an apparatus equipped with a display panel having displayed thereon an image of a video signal input thereto and a backlight for use for the display panel, there are provided a level-setting means (19) for outputting a signal having a level corresponding to the adjusting level of brightness of the image displayed on the display panel, a thinning means (20) for thinning a signal having a periodic waveform at every pseudo random period that has been set in correspondence with an output level of the level-setting means (19), and a drive means (13), (Q1) for generating a drive signal for driving the backlight based on an output signal of the thinning means (20). With this construction, it is arranged to enable the maintenance of an excellent state of display of the image and to enable the adjustment of the brightness of the backlight to be performed over a wide range without generating any noises.

9 Claims, 2 Drawing Sheets

METHOD OF DRIVING BACKLIGHT, CIRCUIT FOR DRIVING BACKLIGHT, AND ELECTRONIC APPARATUS

BACKGROUND OF THE INVENTION

1. Field of the Invention

The present invention relates to a method of driving a backlight, which drives a backlight that a liquid crystal display panel, etc. need to use therefor, a circuit for driving a backlight, to which this driving method has been applied, and an electronic apparatus in which this drive circuit has been incorporated.

2. Description of the Related Art

Among the liquid crystal image display apparatuses, there are some ones that need to use a backlight. For example, in the case of a small-sized image display apparatus that is used as a view finder which has been incorporated in a video camera, a planar fluorescent tube was used as the backlight. And by the fluorescence that occurs in this planar fluorescent tube, the liquid crystal panel was illuminated from a back surface thereof so that an image displayed on the liquid crystal panel might be visually recognized.

Here, the way of driving a conventional planar fluorescent tube when this tube has been used as a backlight will be explained below. Namely, from a video signal of the image displayed on the liquid crystal display panel, a horizontal synchronizing signal is separated to thereby produce a pulse signal whose period is synchronized with that of the horizontal synchronizing signal. The planar fluorescent tube was driven by the pulse signal with that horizontal period. Accordingly, by performing a pulse discharge using the pulse signal during the horizontal blanking period of the image displayed on the liquid crystal display panel, the planar fluorescent tube was fluoresced in a planar fashion. By doing so, fluorescence processing was performed in synchronism with the image displayed on the liquid crystal panel.

FIG. 1 is a view illustrating an example of a conventional pulse signal for driving a conventional backlight. A pulse signal whose period corresponds to the period of a horizontal frequency fH is continuously generated and that pulse signal is supplied to a drive circuit for driving a backlight. It was thereby arranged that fluorescence processing based on this pulse signal be performed. By performing such drive of the backlight using the horizontal blanking period, the cyclic period in which the backlight is fluoresced and the state in which the image is displayed are synchronized with each other. As a result of this, excellent display can be made which stands on the prevention of flickers, etc. of the displayed image that occur due to the failure of synchronization between the fluorescence of the backlight and the image.

Meanwhile, in the image display apparatus such as an electronic view finder or the like, it is preferable that the brightness of the image displayed on the display panel be able to be adjusted. In the case of the image display apparatus that has used the above-described backlight, it is possible to adjust the brightness of the image by changing the luminance of the fluorescence of the backlight. Here, in a case where there is made a construction wherein a pulse signal having the horizontal period such as that illustrated in FIG. 1 is supplied to the drive circuit for the backlight to thereby cause fluorescence thereof, it was carried out to change the pulse width $P_W$ of the pulse signal supplied to the drive circuit for the backlight in response to an adjusting value for adjusting the brightness at that time. Namely, when suppressing the luminance of the fluorescence of the backlight to be low, it was carried out to make narrow the pulse width $P_W$ of the respective pulse signal. While, when making the luminance of the fluorescence high, it was carried out to make wide the pulse width $P_W$ of the respective pulse signal.

However, when changing the brightness of the backlight by the above-described change of the pulse width, there was a limitation. That is, if making excessively narrow the pulse width $P_W$ of the respective pulse signal, the discharged state of the planar fluorescent tube inconveniently becomes insufficient to cause uniform fluorescence of the tube as a whole. Accordingly, in a case where adjusting the brightness of the backlight only by setting the pulse width, the range over which the brightness can be adjusted becomes inconveniently limited.

In order to adjust the brightness over a range that is wider than the adjustment range that can be realized only by this change of the pulse width, it is sufficient, for example, to decrease the frequency of the pulse signal for driving the planar fluorescent tube to ½ or ⅓ and to drive the planar fluorescent tube by the lower frequency pulse signal. By doing so, it becomes possible to perform the adjustment of the brightness beyond said adjustment range that uses the pulse width. However, because the frequency of the original horizontal synchronizing pulse is 15.75 kHz, in a case where having lowed the frequency of the pulse signal of 15.75 kHz to ½ or ⅓ thereof, this frequency becomes several kilohertz or so. Here, the band of several kilohertz or so is the one within which a human being can perceive the signal as a sound. Therefore, in a case where having driven the fluorescent tube constituting the backlight with a signal having a frequency of approximately 8 kHz, for example, which is the value that has been obtained by lowering to ½, the sound with which the fluorescent tube and its drive circuit resonate at 8 kHz is inconveniently heard to the user. Therefore, the noises that are jarring to the ears are heard at all times. Accordingly, there was the problem that merely lowering the frequency of the pulse signal was unable to excellently adjust the brightness of the backlight.

SUMMARY OF THE INVENTION

The present invention has been made in view of the above-described problems and has an object to maintain an stable state of display of the image while performing the brightness adjustment of the backlight over a wide range without causing the generation of any noises.

To attain the above object, in a backlight-driving method of the present invention, it is arranged to thin a signal having a periodic waveform at every pseudo random period set in correspondence with an adjusting level of brightness, and to supply this thinned signal to an illuminating means for illuminating a back surface of a panel having displayed thereon an image as its drive signal.

According to this backlight-driving method, the thinned state of a signal that is thinned in correspondence with the brightness-adjusting level has a pseudo random period corresponding to the brightness-adjusting level. And, by this signal that has been thinned at this period or periods that are pseudo random, the illuminating means for the backlight is driven.

Also, a backlight-driving circuit of the present invention is equipped with a level-setting means for outputting a signal having a level corresponding to the adjusting level of brightness, a thinning means for thinning a signal having a periodic waveform at every pseudo random period that has been set in correspondence with an output level of the level-setting means, and a drive means for generating a backlight-driving signal based on an output signal of the thinning means.

According to this backlight-driving circuit, the thinned state of the signal that is thinned by the thinning means has a pseudo random period corresponding to the brightness-adjusting level. And, by this signal that has been thinned at this period or periods that are pseudo random, a backlight-driving signal is produced.

Also, an electronic appliance of the present invention is an appliance having a display panel having displayed thereon an image indicated by a video signal that has been input thereto and a backlight for use for this display panel, which is equipped with a level-setting means for outputting a signal having a level corresponding to the adjusting level of the brightness of an image displayed on the display panel, a thinning means for thinning a signal having a periodic waveform at every pseudo random period that has been set in correspondence with an output level of the level-setting means, and a drive means for generating a backlight-driving signal for use for the backlight according to an output signal of the thinning means.

According to this electronic apparatus, the thinned state of a signal that is thinned by the thinning means has a pseudo random period corresponding to the brightness-adjusting level. And, by this signal that has been thinned at this period or periods that are pseudo random, the backlight is driven to make its fluorescence.

DETAILED DESCRIPTION OF THE PREFERRED EMBODIMENT

Figure 2:
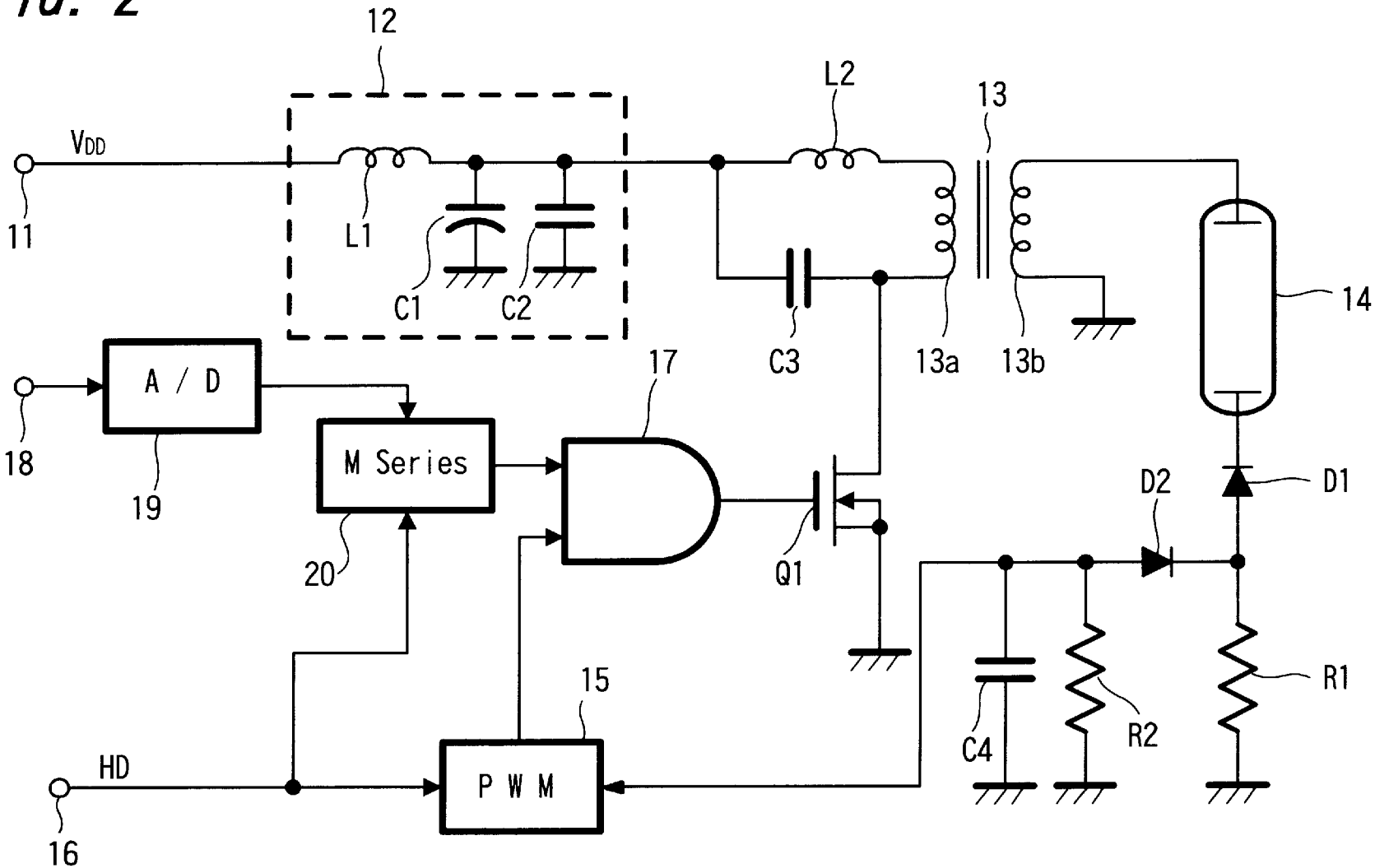
FIG. 2 is a schematic diagram illustrating a according to an embodiment of the present invention.

An embodiment of the present invention will now be explained with reference to FIGS. 2 and 3.

In this embodiment, reference is made to a backlight that has been mounted on the back surface of a relatively small-sized liquid crystal image display panel (the panel whose image screen has a diagonal length of 1 inch to 2 inches or so), which is used as an electronic view finder that is equipped to a video camera apparatus. In FIG. 2 illustration is made of a drive circuit for driving the backlight. In FIG. 2, the circuit of a liquid crystal image display panel side is omitted. Here in this embodiment a planar fluorescent tube 14 is used as the backlight. Explaining a circuit construction that is connected to a secondary side 13*b* of the transformer 13, and the other end thereof is connected to the earth via a serial circuit that consists of a diode D1 and a resistor R1. Also, the connection point between the diode D1 and the resistor R1 is connected to a control input of a pulse width modulation circuit (PWM circuit) 15 via a diode D2. It is to be noted that between the diode D2 and the pulse width modulation circuit 15 there are connected one end of a resistor R2 and one end of a capacitor C4, and the other end of this resistor R2 and the other end of the capacitor C4 are respectively earthed. The circuit that has been connected from the other end side of this planar fluorescent tube 14 to the control input of the pulse width modulation circuit 15 functions as a circuit for detecting the current flowing through the planar fluorescent tube 14 (hereinafter referred to as "tube current") as a voltage level.

To the pulse width modulation circuit 15 is supplied a horizontal synchronizing pulse HD from a horizontal synchronizing pulse input terminal 16. The horizontal synchronizing pulse HD that is obtained at this input terminal 16 is a pulse signal that has been produced from a horizontal synchronizing signal, which has been obtained by being separated from a video signal, which causes the production of an image displayed on the liquid crystal image display panel. In other words, here, a horizontal frequency $f_H$ of the image displayed on the liquid crystal display panel is 15.75 kHz, with the result to this planar fluorescent tube 14, a power source whose voltage $V_{DD}$ and is obtained at a power source input terminal 11 is connected to a primary side 13*a* of a transformer 13 via a power source filter 12. In this case, the video camera of this embodiment is an electronic apparatus that is driven by a battery. Here, the power source voltage $V_{DD}$ is a voltage that depends on the battery voltage applied from the battery, and this power source voltage has a value that is not stabilized to a fixed voltage value. For example, this power source voltage is a voltage that falls within the range of 5 V to 10 V or so.

The power source filter 12 is a filter that is consisted of a coil L1 and capacitors C1, C2 and that eliminates the noises contained in the power source. Between the power source filter 12 and one end of the primary side 13*a* of the transformer 13 is connected a coil L2 while between the power source filter 12 and the other end of the primary side 13*a* of the transformer 13 is connected a capacitor C3. And the connection point between this capacitor C3 and the primary side 13*a* of the transformer 13 is earthed via a path between a source and a drain of a field effect transistor Q1. To a gate of the field effect transistor Q1 is supplied an output of an AND gate circuit 17. Then, by the output of the AND gate circuit 17, "on"/"off" between the source and the drain of the field effect transistor Q1 is controlled.

One end of the planar fluorescent tube 14 is connected that a pulse signal having a frequency of 15.75 kHz is supplied to the input terminal 16. Here, it is arranged that the duration in which the pulse signal is high level corresponds to the horizontal blanking period of the video signal.

The horizontal synchronizing pulse HD obtained at the input terminal 16 is supplied to the pulse width modulation circuit 15, and the pulse width of this pulse signal is changed according to the detected level of the tube current, thereby performing the pulse width modulation. However, the amount of change in the pulse width due to the pulse width modulation performed here is so set as to fall within a relatively small range. Namely, this amount of change is so set as to fall within a range that is wide enough only to make it possible to compensate for the change in the tube current due to the change in the power source voltage $V_{DD}$, etc. Namely, this amount of change is limited to such an extent as to enable the fluorescence of the planar fluorescent tube 14 due to the output pulse to be excellently made over the entire flat surface thereof even when the pulse width has been set the narrowest. Also, the pulse width is so set as not to go beyond the horizontal blanking period of the video signal even when the pulse width has been set the widest. And, the horizontal synchronizing pulse signal, whose pulse width has been modulated by the pulse width modulation circuit 15, is supplied to one input terminal of the AND gate circuit 17.

Also, the horizontal synchronizing pulse HD obtained at the input terminal 16 is supplied to an M series circuit 20.

This M series circuit 20 is operated using the horizontal synchronizing pulse supplied thereto as a clock and outputs a pseudo random pulse signal that is a M series signal. That is, a pulse signal, whose level is inverted with one period to several periods, each of which corresponds to the period of the horizontal synchronizing pulse as a unit, is produced. This period in which the level is inverted is set by the pseudo random pulse signal that has been produced by the M series circuit 20. The random signal here is a pseudo random signal that stands on the M series signal. Therefore when averaging is done over some large length of time, the ratio between the sum total of the periods in which the output level is high and the sum total of the periods in which the output level is low becomes a predetermined value.

Here, it is arranged that the brightness adjustment data, which has been obtained by converting a brightness adjustment voltage obtained at a brightness-adjusting voltage input terminal 18 to digital data through the operation of an analog/digital converter 19, be supplied to the M series circuit 20. Specifically, the brightness-adjusting voltage of the view finder, that has been produced according to the operations of a key, a volume, etc. disposed on this electronic apparatus (video camera), is converted to the digital data by the analog/digital converter 19. And it is thereby arranged that, by the thus-converted digital data, the ratio between the average of the periods in which the output level becomes high in the M series circuit 20 and the average of the periods in which the output level becomes low therein be adjusted.

For example, when the brightness adjustment voltage obtained at the input terminal 18 is at the highest value (i.e., in a state of its having been adjusted to the highest level of brightness), it is arranged that the output level of the M series circuit 20 become continuously high. As the value of the brightness adjustment voltage becomes smaller from this state, the output level of the M series circuit 20 comes to have the inversion repeated between the high level and the low level. It is thereby arranged that the ratio between the average of the high-level periods and the average of the low-level periods becomes such that the low-level period sum total becomes gradually longer.

And, the pulse signal that is output from the M series circuit 20 is supplied to the other input terminal of the AND gate circuit 17. As stated previously, to the one input terminal of the AND gate circuit 17 is supplied the pulse signal, whose period is the horizontal period, output from the pulse width modulation circuit 15. Then the horizontal-period pulse signal is output from the AND gate circuit 17 during the periods in which the output of the M series circuit 20 is high in level.

The output pulse of the AND gate circuit 17 is supplied to the gate of the transistor Q1. During the period in which the output of the AND gate circuit 17 is high in level, an "on" state occurs between the source and the drain of the transistor Q1. On the other hand, during the period in which the above-mentioned output is low in level, the transistor Q1 is made "off" between the source and the drain.

Next, the way in which the planar fluorescent tube 14 is driven by the above-constructed circuit will be explained with reference to the waveform diagram of FIG. 3. It is assumed here that the brightness-adjusting voltage obtained at the input terminal 18 is a voltage value by which the brightness, appreciably reduced from the maximum luminance, is indicated. At this time, as illustrated in (a) of FIG. 3, the output pulse of the M series circuit 20 has repeated the inversion of level between the high-level period and the low-level period. At this time, while the period in which the inversion is made is random, this period becomes constant when averaging is done over a large length of time.

Figure 1:
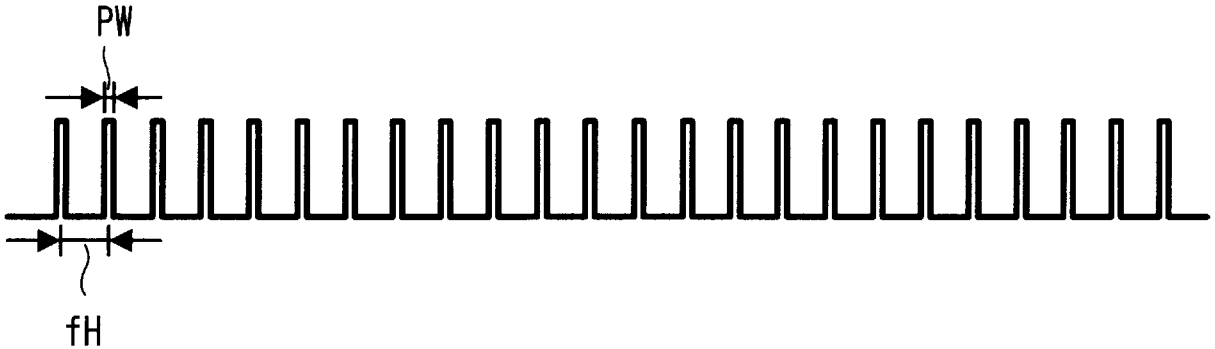
FIG. 1 is a waveform diagram illustrating an example of a conventional signal waveform for driving a backlight.
Figure 3:
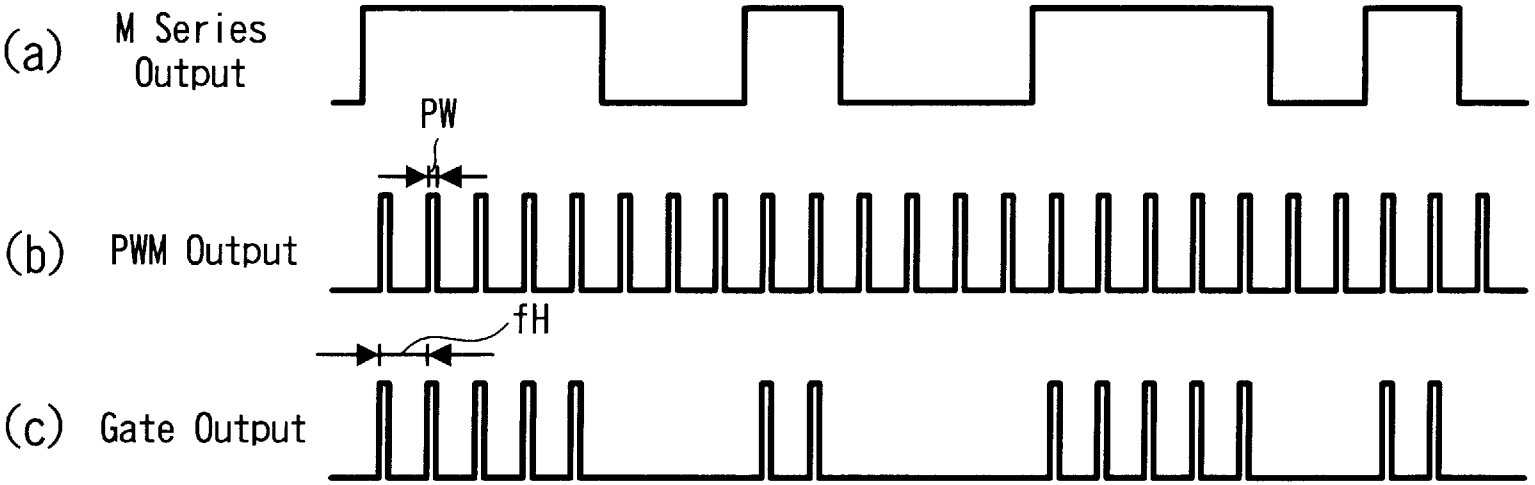
FIG. 3 is a waveform diagram illustrating an example of a signal-processed state according to the embodiment of the present invention.

And, while as illustrated in (b) of FIG. 3 the pulse width modulation circuit 15 outputs a pulse signal with a period of the horizontal frequency $f_H$, the pulse width $P_W$ of the respective pulse signal is the one which has been controlled by the detected tube current.

The output of the M series circuit 20 illustrated in (a) of FIG. 3 and the output of the pulse width modulation circuit 15 illustrated in (b) of FIG. 3 are supplied to the AND gate circuit 17. Whereby, a pulse illustrated in (c) of FIG. 3 is obtained as the gate output which is an output corresponding to a logical product of the both outputs. In this gate output, during, and only by, the periods in which the output of the M series circuit 20 is high in level, the pulse whose period corresponds to that of the horizontal frequency is output. This output of the AND gate circuit 17 illustrated in (c) of FIG. 3 is supplied to the gate of the transistor Q1, whereby the "on"/"off" control of the transistor Q1 is performed.

Accordingly, with the circuit construction of this embodiment, to the planar fluorescent tube 14 is supplied a discharge current from the transformer 13 at the frequency of the horizontal frequency, and resultantly the planar fluorescent tube 14 fluoresces in a flat fashion during the horizontal blanking period of the image displayed on the liquid crystal display panel. And correspondingly to the adjusted state of the brightness at this time, the blanking period during which discharge current is supplied is randomly thinned. By this random thinning, the brightness as that of the backlight is adjusted, with the result that the image displayed on the liquid crystal image display panel can be illuminated from the back surface thereof with a given level of brightness. Here, in this embodiment, the period that is thinned correspondingly to the adjustment of the brightness is a pseudo random period, and so it does not happen that this drive circuit resonates with a particular frequency. Namely, the generation of noises in voice band, which occurred when simple thinning to ½, ⅓, etc. had been performed as was explained in connection with the prior art, does not occur. Also, in the case of this embodiment, a loop is constructed of controlling the pulse width of the horizontal synchronizing pulse signal by means of the tube current. Therefore, even when fluctuations have occurred in the voltage of the power source obtained at the input terminal 11, the set level of brightness can be maintained as is. Further, even in a case where having used a power source that is not stabilized, there is the advantage that the planar fluorescent tube 14 stably fluoresces at an adjusted level of brightness.

Incidentally, although in the above-described embodiment a construction has been made of detecting the tube current and performing the pulse width modulation by the thus-detected tube current, in a case where using a power source voltage that has been stabilized to a fixed voltage, a circuit construction wherein the construction for detecting the tube current and the pulse width modulation circuit 15 have been omitted may be used.

Also, in the above-described embodiment, reference has been made to the drive circuit of the backlight that is used for a relatively small-sized liquid crystal display panel, which is used as one component of the electronic view finder equipped to a video camera. However, the invention can also be applied to the drive circuit of a backlight for use for an image display panel that is equipped to various other kinds of electronic apparatus. For example, in the case of a fluorescent tube that serves as the backlight for use for a relatively large area of panel, when driving this fluorescent tube by a sine wave signal, it may be arranged to perform thinning of that sine wave at random periods, each prepared by using one period thereof as a unit, according to the pseudo random signal that has been produced in correspondence with the adjusting value of the brightness.

According to the method of driving a backlight described in claim 1, the signal, which has been thinned at periods that are pseudo random in correspondence with the adjusting level of the brightness, is produced. And by the signal that has been thinned at these periods that are pseudo random, the backlight is driven, and, by setting the percentage of thinning, it is possible to adjust the fluorescence luminance of the backlight. And, in the case of a state where thinning has been done, there is no possibility that the backlight is driven by predetermined state. It is thereby possible to stably adjust the brightness of the backlight without generating any noises in a voice band, for example.

According to the method of driving a backlight described in claim 2, in the invention described in claim 1, the periodic-waveform signal is a pulse signal having a frequency synchronized with the horizontal synchronizing signal of an image displayed on the panel. As a result of this, it is possible to excellently drive the backlight with the use of only the blanking period of the image.

According to the method of driving a backlight described in claim 3, in the invention described in claim 2, the pulse width of the pulse signal is controlled by the state of the signal applied to the backlight. As a result of this, there is formed a control system wherein the brightness is controlled to be constant through the adjustment of the pulse width. Resultantly, an excellent drive control of the fluorescence of the backlight can be performed, wherein the level indicated by the brightness-adjusting level is maintained as it is.

According to the backlight-driving circuit described in claim 4, there can be obtained a drive circuit wherein the thinned state of signal that is obtained by thinning of the thinning means has a pseudo random period that corresponds to the brightness-adjusting level; by setting the percentage of thinning, it is possible to adjust the fluorescence luminance of the backlight, and simultaneously, in the case of a state where thinning has been done, there is no possibility that the backlight is driven by the signal which is in a predetermined state, so that it is possible to excellently adjust the brightness of the backlight without generating, for example, any noises inside the voice band.

According to the backlight-driving circuit described in claim 5, in the invention described in claim 4, the periodic-waveform signal that is supplied to the thinning means is a pulse signal having a frequency synchronized with that of the horizontal synchronizing signal of the video signal. As a result of this, there can be obtained a drive circuit that excellently drives the backlight by using only the blanking period alone of the image.

According to the backlight-driving circuit described in claim 6, in the invention described in claim 5, there is provided a pulse width modulation means for controlling the pulse width of the pulse signal by the state of the signal applied to the backlight. As a result of this, there is performed a control operation of controlling the brightness to be constant through the adjustment of the pulse width. Resultantly, an excellent drive control of the fluorescence of the backlight can be performed, wherein the level indicated by the brightness-adjusting level is maintained as it is.

According to the electronic appliance described in claim 7, the thinned state of signal that is obtained by thinning of the thinning means has a pseudo random period that corresponds to the brightness-adjusting level; by setting the percentage of thinning, it is possible to adjust the fluorescence luminance of the backlight, and simultaneously, in the case of a state where thinning has been done, there is no possibility that the backlight is driven by the signal which is in a predetermined state, so that it is possible to excellently adjust the brightness of the backlight for use for the display panel without generating, for example, any noises within the voice band.

According to the electronic apparatus described in claim 8, in the invention described in claim 7, the periodic-waveform signal that is supplied to the thinning means is a pulse signal having a frequency synchronized with that of the horizontal synchronizing signal of the video signal. As a result of this, it is possible to excellently perform the luminance control of the backlight by the fluorescence that is made during only the blanking period of the image.

According to the electronic appliance described in claim 9, in the invention described in claim 8, there is provided the pulse width modulation means for controlling the pulse width of the pulse signal by the state of the signal applied to the backlight. As a result of this, there is performed a control operation of controlling the brightness to be constant through the adjustment of the pulse width. Resultantly, an excellent drive control of the fluorescence of the backlight can be performed, wherein the level indicated by the brightness-adjusting level is maintained as it is.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A method of driving a backlight, comprising the steps of:

generating a first signal;

generating a pseudo random signal having a pseudo random period that is a function of a brightness adjusting level;

combining the first signal and the pseudo random signal to produce a thinned signal having a periodic waveform at every pseudo random period; and driving a backlight using the thinned signal as a drive signal, said backlight illuminating a back surface of a panel having displayed thereon an image.

2. A method of driving a backlight according to claim 1, wherein the thinned signal is a pulse signal having a frequency synchronized with a horizontal synchronizing signal of an image displayed on the panel.

3. A method of driving a backlight according to claim 2, wherein a pulse width of the pulse signal is controlled in correspondence with a signal applied to the backlight.

4. A circuit for driving a backlight, comprising:

first generating means for generating a first signal;

level-setting means for outputting a signal having a level corresponding to a brightness adjusting level;

second generating means for generating a pseudo random signal having a pseudo random period set by the output signal of said level-setting means;

combining means for combining the first signal with the pseudo random signal to produce a thinned signal having a periodic waveform at every pseudo random period; and driving means for driving a backlight using the thinned signal as a drive signal.

5. A backlight-driving circuit according to claim 4, wherein the thinned signal is a pulse signal having a frequency synchronized with a horizontal synchronizing signal of a video image.

6. A backlight-driving circuit according to claim 5, further comprising:

pulse width modulation means for controlling a pulse width of the pulse signal by using a signal applied to the backlight.

7. An electronic apparatus, comprising:

first generating means for generating a first signal;

display means for displaying a video image;

level-setting means for outputting a signal having a level corresponding to an image brightness adjusting level;

second generating means for generating a pseudo random signal having a pseudo random period set by the output signal of said level-setting means;

combining means for combining the first signal with the pseudo random signal to produce a thinned signal having a periodic waveform at every pseudo random period; and driving means for driving a backlight using the thinned signal as a drive signal, wherein the backlight illuminates the display panel.

8. An electronic apparatus according to claim 7, wherein the thinned signal is a pulse signal having a frequency synchronized with a horizontal synchronizing signal of the video image.

9. An electronic apparatus according to claim 8, further comprising:

modulation means for controlling a pulse width of the pulse signal in correspondence with a signal applied to the backlight.

* * * * *